United States Patent [19]

Vallon et al.

[11] 4,173,675

[45] Nov. 6, 1979

[54] METHOD FOR COLORING OR DYING FIBROUS SHEETS IMPREGNATED WITH BITUMINOUS MATERIAL

[75] Inventors: Roger Vallon; André Herdenberger, both of Rouen; Marc Delhomelle, Elbeuf, all of France

[73] Assignee: Société Anonyme dite: Omnium Francais Industriel et Commercial (O.F.I.C.), Paris, France

[21] Appl. No.: 800,810

[22] Filed: May 26, 1977

[30] Foreign Application Priority Data

May 28, 1976 [FR] France ..... 76 16263

[51] Int. Cl.[2] ..... B05D 1/12; B32B 11/02; B32B 11/62; D06N 5/00; D06P 1/673

[52] U.S. Cl. ..... 428/291; 8/18 R; 427/186; 427/203; 427/404; 427/411; 428/280

[58] Field of Search ..... 428/291; 427/203, 186, 427/402; 8/3, 18 R, 52

[56] References Cited

FOREIGN PATENT DOCUMENTS

| | | | |
|---|---|---|---|
| 1619291 | 6/1966 | Fed. Rep. of Germany | 428/291 |
| 2006265 | 2/1970 | Fed. Rep. of Germany | 428/291 |
| 1236790 | 6/1960 | France | 428/291 |
| 257012 | 4/1964 | Netherlands | 428/291 |

OTHER PUBLICATIONS

Tepen (C.S.T.B. Document) Specification No. 1292, Issue 155, Dec. 1974, France.

*Primary Examiner*—J. C. Cannon

*Attorney, Agent, or Firm*—Sprung, Felfe, Horn, Lynch & Kramer

[57] ABSTRACT

The present invention relates to a process for coloring or dyeing a material formed essentially from a substrate impregnated with bitumen, said method being characterized in that a colored composition is applied, in particular a pigmented composition, to the substrate before the impregnation of the latter by the bitumen. It also concerns the material thus obtained, characterized by a color gradient between the surface and the inside of the substrate, the color intensity decreasing continuously and practically regularly from the surface.

14 Claims, 4 Drawing Figures

METHOD FOR COLORING OR DYING FIBROUS SHEETS IMPREGNATED WITH BITUMINOUS MATERIAL

The present invention relates to a method for colouring or pigmenting bituminous materials, notably roofing, siding or sealing materials, impregnated or saturated with bitumen, and to the products thus produced.

This invention relates more particularly to a method for colouring or pigmenting such materials, formed of cellulosic felt, of cardboard or of fibrous materials impregnated or saturated with bitumen, and to the new products produced by said method.

By way of fibrous materials, there may be used for example materials based on absestos.

Roofing or siding elements are already konwn in the form or rolls or in corrugated sheets, of self-supporting structure, and which are preferably, to be rendered more attractive, painted or covered with a mineral type, coloured, granulated coating.

Known coatings of this type, applied to the surfaces of said roofing or siding elements, have a very variable ageing resistance according to the nature of the coating and colouring products used.

When they are subjected to U.V. radiation, to rain, to snow, to freezing and to thawing, these coatings of known type have a life span which does not exceed 15, or even 10 or perhaps only 5 years, according to the technique utilised for their application and to the climatic conditions to which they are subjected.

Progressively with their degradation, these coatings permit the original aged, greyish support to appear, and this by a progression of zones and/or spots which are gradually extended over the whole exposed surface.

The need has therefore become very distinctly felt to have available a roofing, siding (sheathing) or sealing material which would maintain practically unaltered over time its surface properties, in particular its colouring or pigmentation, and which would resits extreme climatic conditions.

In spite of repeated efforts in this direction, a satisfactory result has not hitherto become available, even by resorting to costly materials, as well as to elaborate and expensive techniques.

The prior art of the technique may be illustrated by the following documents:

NL Patent Application 257,017 describes the manufacture of coating or roofing sheets utilising a mat of glass fibers, a PVC resin with plasticizer (hence for surface coating and plasticizing) and if necessary, but subsequently (that is to say after plasticizing, hence necessarily with limitation to the outer surface), a coating of bitumen, which constitutes a protective outer coating (see on page 5, paragraph 2). It is also proposed, to remedy the unattractive appearance constituted by the bitumen, to coat the latter with an adherent layer of external coloured granules.

The notice on sealing coating TEPEN (C.S.T.B.) Specification No. 1292, issue 155 of December 1974, describes a sealing coating the originality of which is ascribed to the fact that it comprises, in its multi-layer structure, at least one sheet (manufactured independently) comprising:

(1) a glass core in middle position, (2) an impregnation and a surfacing ASBA composite (bitumen modified by a copolymer of polystyrene/polybutadiene/polystyrene), (3) addition of a polyester film to one surface, and (4) a light coating of bitumen.

It should be noted that this very sophisticated elaboration only relates to the applied sheet, intended to confer on the finished composite material its improved sealing properties. As regards the sheet itself, there is no impregnation with bitumen provided for, but only a coating, which is very different, on one of the surfaces or on both surfaces (see on page 3, two last paragraphs of section 3).

The sheet thus produced differs distinctly from the material according to the present invention, as much in its structure as in the properties that it possesses and this is confirmed by the fact that the use for which it is intended has nothing to do with that for which the material according to the invention must be satisfactory, as can clearly be seen on page 6, section 2 of the cited document, the abovesaid sheet (called TEPEN) has a sensitivity to ageing by exposure to light which is insufficiently known, and it is stated that this is only a secondary importance, since the membrane is not intended to remain exposed.

FR Patent No. 1,236,790 simply describes one technique, now old, for producing insulating or roofing sheets, comprising cardboard impregnated (previously) with tar oil and to which there is added, after the impregnation with tar oil, either in a mixture with the latter (but never before, for the good reason that the tar oil would then no longer pass through the resin layer), a synthetic resin, notably PVC, compatible with the tar oil and polymerisable, (see on page 2, left-hand column, lines 19–28 and 31–34).

DT-OS Patent application No. 1,619,291 describes a roofing material having an improved weather resistance, but which, to possess this property, includes a coating by means of a dispersion of resin or other synthetic material, free of plasticizer, on a covering sheet already including a bituminous sub-layer (see pagee 4, lines 6–12). This method described in this DT-OS patent application is aimed at nothing other than to provide with a protective outer layer of resin, a bituminous sheet already impregnated with bitumen and possibly already dyed.

DT-OS patent application No. 2,006,265 describes a method for producing sheets or plates, notably for roofs, which consists of providing the plates or sheets, which are based on polyethylene (or on a copolymer comprising polyethylene) already containing bitumen, with a second layer of a dispersion of a little plasticized resinous substance, having the purpose of reducing the sticky nature of the plates or sheets.

It has now been found, unexpectedly, that it is possible to produce roofing, siding or sealing materials whose colouration has exceptional behaviour and resistance to external attacks by applying to at least one of the surfaces of the material to be treated, constituted by a cellulosic felt, a cardboard or a fibrous material, a coating or colouring composition, by drying, then by impregnating the thus-coated material, if necessary to saturation, in a conventional hot bitumen bath.

According to one aspect of this invention, there is provided a method for colouring or dyeing a material formed essentially from a substrate impregnated with bitumen, said method being characterised in that a coloured composition is applied, in particular a pigmented composition, to the substrate before impregnation of the latter with the bitumen.

According to another aspect of the invention, the invention relates essentially to a coloured or dyed material, formed from a substrate impregnated with bitumen, said material being characterised by a colour gradient between the surface and the interior of the substrate, the colour intensity decreasing continuously and practically regularly from the surface.

It is remarkable and unexpected to observe that by operating in this manner, not only is the hue or dye conferred on the one or more surfaces of the material unaltered before the subsequent impregnation with bitumen and under the effect of this impregnation, but on the contrary by this method there is provided the benefit of a colouration which is more stable, more lasting and more homogeneous whilst however being achieved with less material and particularly without bringing into action complex and laborious steps. In fact, even if the surface or surfaces of the ceellulosic felt or of the cardboard are only coated with a thin layer, not exceeding some microns of the desired colouring composition, there is produced according to the invention, an intimate bond, at the level of the sublayer; with said surface of the treated material.

Simultaneously, complete impregnation with the bitumen is achieved, if desired up to saturation, and this even through the already coloured surface, although it would have been expected on the contrary that the latter would form an obstacle to the penetration of the hot bitumen to the interior or the cellulosic felt or cardboard material, and even would disappear under the action of the bitumen.

This is quite surprising and unexpected result. Without intending to be bound to any particular theory, it is possible however to attempt to explain this result by the combined effect of the deposition of a thin layer of the desired coloured coating on the one or more surfaces of the material, of the passage and of the cooking of said layer by the hot bitumen, during the subsequent impregnation operation, said impregnation being carried out in a conventional manner.

The coating or colouring composition is a composition similar to a paint, but possessing original relationships between the binder, pigment, filler, dispersant and thickener. In general, the composition contains a proportion of water which is exceptionnaly high with respect to conventional emulsion or aqueous dispersion paint.

Good results have been obtained with coating or colouring compositions comprised between (1) a composition including about, by weight, 25% of pigment, 5% of resin binder in emulsion or aqueous dispersion, 1°/oo (1 per thousand) of dispersing agent and 1°/oo of thickening agent, the remainder being water, and (2) a composition including about, by weight 7% of pigment, 40% of fillers, 50% of resin binder in an emulsion or aqueous dispersion, 1°/oo of dispersing agent and 1°/oo of thickening agent, the remainder being water.

According to the invention, the coating or colouring thus effected on at least one of the surfaces of the treated material, by conventional application notably by spray gun or by curtaining or rolling application, can be maintained as such and represent the outer appearance offered by said material, or as an embodiment, the thin layer, thus applied and fixed according to the invention, can be covered with a surface coating or a conventional paint, whose resistance may not be as great as that of said thin layer and wich allows the latter to appear when it flakes off through ageing. According to this embodiment, it is convenient therefore in practice for the thin layer and the surface coating to be practically identical in dye or at least similar or neighbouring.

Ageing tests to which various coated materials obtained by the method according to the invention have been subjected, have enable it to be established in very distinct manner that said coatings have an exceptional ageing resistance, despite the very slight thickness, of the order of 5 to 10 microns, which they may possess.

Samples prepared according to the invention have been subjected to the following ageing tests:

natural ageing for four years, with different exposures;

accelerated ageing in a climatic enclosure, according to French standard AFNOR T 30 049 for paints and varnishes;

accelerated ageing in a climatic enclosure, according to American standard ASTM D 529-62 "Accelerated weathering test of bituminous materials", freeze-thaw tests of the material, at −20° C. and at +50° C. in air and in water, at the rate of one cycle in 24 hours.

According to the invention there is also provided a material constituted by a substrate impregnated with bitumen, and bearing on at least one of its surfaces a coloured coating, said material being characterised in that it has a colour gradient, said colour being in fact formed in depth and decreasing in intensity, in practically continuous manner, from the surface to the interior of the material.

The material according to the invention, the colouring agents, in particular the pigments, the metallic pastes and powders, confer a maximum colouring intensity on the surface of the material, and are distributed in practically continuous manner in penetrating to the interior of the material.

By way of example, when a substrate besed on cellulosic fibres and pigments as colouring agents are used, the density of the pigments as maximum at the surface of the material over a depth of about 5 to 10 microns, after which, this coloured layer is followed in practically continuous manner in a zone where the density of the pigment decreases towards the interior of the material, this zone being able to have, for example, a depth of the order of 20 microns. Following this zone, inside the material is found the bituminous binder practically devoid of pigments.

It is hence possible to speak truly of a colour gradient in a material according to the invention. This characteristic offers numerous practical advantages. The colouration being effected in depth, there is observed firstly a better adherance of the pigment to the substrate. There is also observed a good resistance to ageing of the material. Such characteristics have much interest if the material is to be used in the field of roofing or siding.

Up to the present, in fact, the bituminous substrate was simply coated with a coloured layer containing dyes or pigments. Such a layer did not have good adherance to the substrate, and had a tendency to become detached and to flake off, for example under the effect of bad weather, if the material was applied as a roofing material. A microscopic examination of a section through a known material showed a distinct discontinuity between the surface-coloured layer and the interior of the bituminous substrate. In comparison, examination with a microscope of a section of a roofing material according to the invention reveals on the contrary an absence of discontinuity, and a colour gradient, as has been explained previously. In this case, the pigments are distributed in a zone of some tens of microns in thickness, their density decreasing from the surface to the inside of the material. There is noted in particular, the presence between the surface zone of maximum coloration and the inner zone of the bituminous substrate alone, an intermediate zone with low pigment density. The respective values of the colouring zones bary with the substrates, the bitumens and even with the pigments. In addition, for a given material, the entraining of the pigment to a depth would depend on the amount of binder present in the pigmentary composition. It has in fact been observed that the bitumen penetrates inside the substrate to impregnate the latter whilst entraining a portion of the pigment. It must be stressed, in fact, that the essential characteristic of the invention is to apply the cocoloured pigment to the substrate before its impregnation by the bitumen. The more binder contained by the pigmentary composition, the more the latter has a tendency to infiltrate the substrate, and the less the pigment will be entrained in depth on the subsequent impregnation by the bitumen. In this case, in fact, the binder will have more tendancy to hold the pigment on the fibers of the substrate.

The characteristics of the material may depend also on the technique of applying the pigmentary composition; the latter may, in fact, be applied to the substrate by simple spraying or indeed, as preferred, by the dipping technique with an application by a roller exerting a certain pressure on the substrate. In this latter case, the penetration of the pigments is improved.

Whatever is used however as the technique of application, there is observed in the final material, the presence of a colour gradient.

The original particularities of the structure of the novel material can be shown by means of various tests carried out which will now be described, comparing them also with conventional structures of known material.

According to a first test method, it is possible to treat the surface of the material with a solvent capable of softening the coloured layer, but remaining without effect on the bitumen. This technique is moreover conventional for removing paint from its support by causing it to "blister". The solvent is not, properly, a solvent for the paint, but it has the effect of softening it. By way of example of such solvents it may be mentioned alkyl acetates, such as ethyl, butyl or propyl acetate. Such products are, in general, without effect on the bitumen. If such a test method is applied to a conventional material, the softening of the surface layer of paint is caused, and the bituminous substrate is seen to appear in zones entirely devoid of colour. This is moreover a phenomenon similar to that which occurs if the roofing material is subjected to bad weather.

On the other hand, it is observed that if a material according to the invention is treated, the solvent exerts practically no effect on the pigmented layer since the pigment is already enveloped by the bitumen when the latter impregnates the substrate. It must be well understood that, in fact, after impregnation, the bitumen envelops the surface of the pigments and plays the roll of a binder. The pigments enveloped with bitumen are non longer sensitive to the effect of the solvent.

It has even been observed in certain cases, that following ageing tests, the colour of the material according to the invention has more a tendancy to become brighter than to become darker.

Another test method consists of placing samples of materials in an apparatus of the SOXHLET type in which samples are treated systematically with a good solvent for the bitumen (benzene for example), until exhaustion. After extraction of the bitumen, the coloured coating, if it still exists, is easily detached from the support to allow the fibres, free of bitumen and of colour to appear.

In comparison, samples of the material according to the invention still possess a distinct coloration after exhaustion of the solvent, which is easily explained by the fact that the coloration is effected in depth.

The most suitable test method in practice is the conventional test for paints and varnishes called "cross-ruling test for paints and varnishes" according to French standard AFNOR T 30 038.

For the purpose of the invention, it is carried out in the following manner: on the samples to be tested, a cross-ruling formed 11 vertical lines separated by 1 mm and 11 horizontal lines also separated by 1 mm are traced with a scalpel. In the course of the test, care is taken not to make an incision whose depth exceeds that of the presumed thickness of the layer of paint. A cohesion test is then carried out by sticking an adhesive tape to the cross-ruling. By experting a certain predetermined stripping force, the tape is stripped off and the surface of the latter which was in contact with the coloured surface is examined. The adherance quality is measured according to the intensity of the coloured zones held by the tape.

If such a test is applied to a traditional material, before or after ageing, it is observed that small squares of the coloured layer have been stripped off, and that the decohesion has taken place at the level of the support-paint interface. On the contrary, with the material according to the invention, the rare squares stripped off are in fact squares whose decohesion has been effected in the support itself, and which therefore contain fibres and bitumen.

By way of materials used according to the invention, there may be applied any substrate capable of being impregnated by a bituminous substance, in particular substrates based on cellulosic fibres, such as cellulosic felts or cardboards, as well as any other equivalent materials, for example fibrous materials, such as asbestos based materials. It is possible to apply pigments, traditional dyeing agents or metal powders and pastes.

The best results were obtained with pigments which are solid particles of sufficient size to be fastened in the substrate by means of a binder. It is convenient to use pigments resistant to the temperatures to which the substrate is subsequently subjected during impregnation by means of bitumen. This temperature generally reaches 180° C. It is hence optimal to call upon mineral pigments such as titanium dioxide (white hue), iron oxides (red, brown, yellow or black hue), chromium oxides (green hue) and other known mineral oxides. Of course, it is possible to call upon mixtures of such oxides. Metallic powders or pastes also give very good results in metallic hues, silver and gold for example.

The pigment is applied to one and/or other of the surfaces of the material, in the form of a pigmentary composition. Although it is not absolutely necessary to use a binder in such compositions, it is advantageous to resort to a binder to fix the pigment on a substrate in more satisfactory manner. In fact, the binder exerts a double function. In the manufacture of the material, firstly it enables fixing the pigment to the substrate, as has been mentioned, but in addition, in the course of the application of the material, during the ageing of the latter, the binder contributes also to holding the pigment in the substrate.

The nature of the binder has consequences on the formulation of the pigmentary composition. A first category of usable binders is of the thermoplastic type. As has been stated previously, the pigment could be used alone or without a binder; it will hence be understood that the minimal amount of thermoplastic binders to be applied can be as low as about 0.1% of the total weight of the pigmentary composition. In practive, good results have been obtained with amounts of the order of about 2–3% related to the dry extract of thermoplastic binders, with respect to the whole of the composition. Frequently, the binders are placed in contact in an aqueous emulsion form. It will be necessary therefore to take into account specified values calculated in dry extract, to fix correspondingly the amount of aqueous emulsion used. It must be stressed that the amount of thermoplastic binders to be used has nothing critical about it. The optimum amount will vary notably according to the nature of the substrate, in particular its porosity, the radio of filler contained in the substrate, as well as the nature of the impregnating bitumen, the latter exerting in fact an influence on impregnation, according to the temperatures required to enable its hot fluidising. The thermoplastic binder must, as has been stated above, be adapted to the needs, taking into account the fluidising temperature of the bitumen.

The upper limit of the amount of binder does not have a preponderant influence. Thus, satisfactory results have still been obtained by using up to 25% of binders, related to the dry extract, with respect to the total weight of the composition.

Since binders are frequently in the form of an emulsion or aqueous dispersion with 50% of dry extract, the upper limits will be of the order of 50%, calculated by weight of emulsion or of dispersion with respect to the total composition of the preparation.

As thermoplastic binders, there may be used polymers of acrylic or vinyl esters, as well as the copolymers or interpolymers of such esters, and their copolymers with styrene. Advantageously, there may be used butyl acrylate, in particular tertio-butyl acrylate, vinyl acetate, vinyl acetate-acrylic ester copolymers and styrene-acrylic ester copolymers. For a given cellulosic material and for a bitumen also of given characteristics, it is possible to obtain results which vary somewhat with the nature of the thermoplastic binder. By routine experiments, the one skilled in the art can select the resins which provide the best results, choosing them from the categories previously indicated by way of example.

Another category of binders usables in the pigmentary composition is that of the thermosetting binders. This type of binder gives good results with regard to the final quality of the material. In fact, once it is crosslinked, the resin of the binder remains fixed to the fibers of the substrate, which thus enables the realisation under the best conditions of the consecutive impregnation by the bitumen, the latter penetrating easely through the fibers of the substrate. Another advantage of thermosetting binders is their low price. For equal cost, it is hence possible to increase the quantity of binder, which has a favourable result on the ageing of the material. The usable amount of binder can vary within wide limits. Thus, as has been previously noted, the binder can be entirely absent. In addition, amounts of the order of 25% calculated in dry extract of resin with respect to the total weight of the composition have still given good results. For obvious reasons of economy, smaller amounts are used which are still capable of enabling good attachment of the pigment to the substrate.

By way of example of thermosetting binders, it is possible to use phenolic resins, urea-formaldehyde resins, melamine-urea-formaldehyde resins, formaldehyde-phenolic resins and epoxy resins.

It is also possible to use types of so-called thermocrosslinkable resins which, up to a certain temperature, are thermoplastic, and which then have the property of crosslinking above this temperature threshold.

Generally, the composition of the pigments also contains water. In the composition, the water plays the part of a vehicle which helps the good penetration and the good dispersion of the pigment ot effect homogeneous application of the latter. With respect to a conventional formulation of paint, the pigment compositions applied according to the invention contain a larger amount of pigments and of water. However, the amount of water is not critical and, in the limit, the water is not an indispensable vehicle if a technique of application providing a sufficiently homogenous deposit of pigments can be used. It must also be stressed that the binders, whether they are thermoplastic or thermosetting, are applied in the form of emulsion or of aqueous dispersion, which corresponds to an additional introduction of water into the composition. Good results have been obtained in practice by using compositions of pigments containing, in weight with respect to the total weight of composition, 150 to 450 parts of water, 150 parts of binder with 50% resin dry extract, and 10–100 parts of pigment. For the thermosetting binder, the amount of water may represent 60 to 80% by weight of the total composition. This amount can be still higher if the composition contains a thermoplastic binder. As the one skilled in the art will appreciate, the composition of the pigments applied according to the invention contains known constituents of a known paint formulation, but their relative proportions differ appreciably.

The pigment composition can also contain optional ingredients, such as dispersing agents and thickening agents. Concrete examples of such agents will be given below. In the case, notably, where the roller technique of application is used, it is advantageous for the pigment bath to contain also an anti-foaming agent, such as a silicone.

The invention will be illustrated, without being limited in any way by the examples which follow, and by the description made with reference to the figures of the accompanying drawings, in which.

Figure 3:
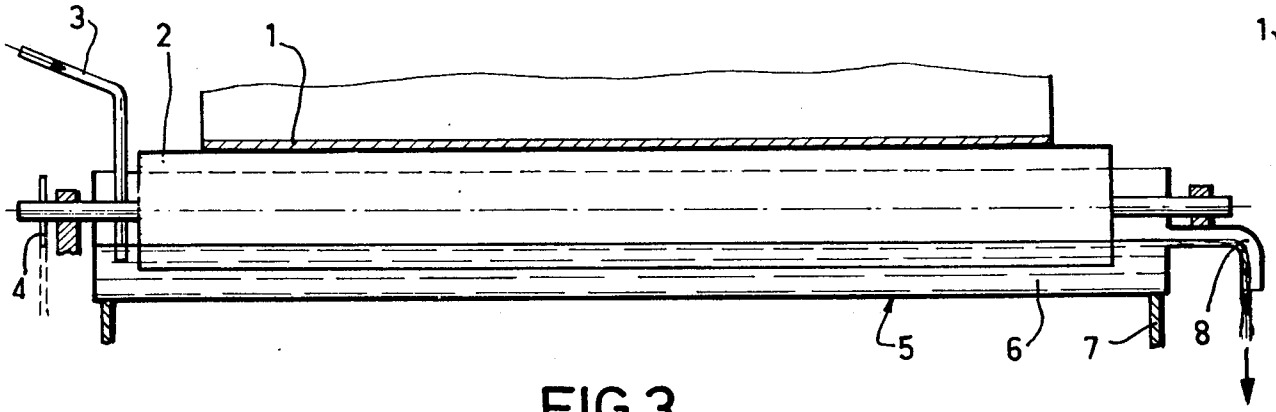
FIG. 3 is an axial section of an installation for the application of a pigment composition.
Figure 4:
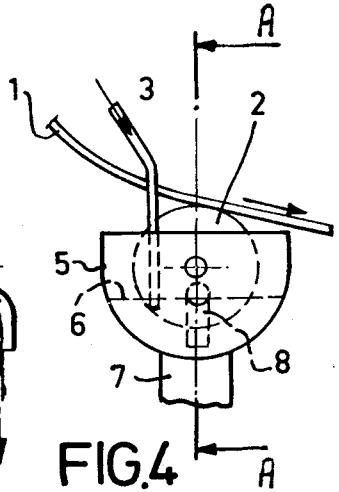
FIG. 4 is an end view of the installation shown in FIG. 3.

It will be noted that FIG. 3 is a section along the plane A—A of FIG. 4.

Figure 1:
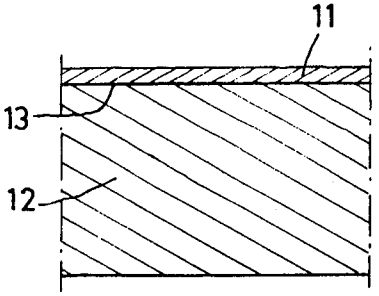
FIG. 1 represents a schematic cross-section of a material according to the prior art.
Figure 2:
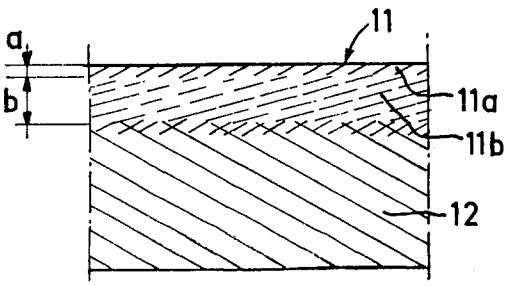
FIG. 2 shows for comparison, the cross-section of an embodiment of the material according to the invention.

In the example described, a sheet of cardboard has been used as a substrate. FIG. 1 represents a sheet conforming to the prior art. Such a sheet 12, previously impregnated with bitumen, has been coated by painting with a coloured layer 11. The distinct zone of discontinuity 13 between the coloured layer 11 and the substrate 12 proper will be noted. The structure of the material according to the invention is shown schematically in FIG. 2. The coloured layer 11 occurs in this case in the form of a continuous layer starting from a surface zone 11*a* of maximum colour and a zone 11*b* in which the colour decreases practically regularly to the proper substrate 12.

The zone 11*a* has for example a thickness a of 5 to 10 microns whilst the zone 11*b* extends over a depth of 15 to 30 microns, for example about 20 microns. This advantageous structure is obtained by, according to the invention, first subjecting the bare sheet of cardboard to the application of the coloured pigment before it receives the bitumen impregnation. During impregnation, that is to say the penetration of the bitumen into the substrate 12, the pigments are slightly drawn into the cellulosic mass, thus obtaining a coloration which is progressive and continuous in depth, without an apparent zone of discontinuity. Once the sheet of cardboard has been impregnared, the bitumen serves as a binder and contributes to ensuring the holding of the pigments together and on the support.

This property is particularly advantageous for sheets serving for roofing and siding. In fact, coloured sheets according to the invention age better than traditional sheets. In the case of the latter, the surface layer 11 separates and flakes off, allowing the dull colour of the bitumen to appear. On the contrary, in the material of the type shown in FIG. 2, the colour of the zone 11*a* is maintained and even reinforced in the course of time progressively as the film of bitumen which envelops the pigment is destroyed. In a way, there is obtained a very satisfactory equilibrium in the colouring of the sheets although, also, the intensity of the colour is reduced under the effect of contact with external dust. The invention hence enables the obtaining of a uniform and regular coloration in the course of time.

There has been shown schematically in FIGS. 3 and 4, a device enabling the application of the pigment composition to a sheed of cardboard. According to the invention, this application is done on the sheet of cardboard before its impregnation with bitumen. As is shown in FIGS. 3 and 4, the sheet of cardboard to be pigmented, before its impregnations 1 passes in contact with the pigmentation roller 2. This roller can be covered with a synthetic foam and applied under a certain pressure against the sheet 1 by means not shown. The lower portion of the roller 2 dips into a pigment bath 6. The pigmentary composition arrives in the tank 5 through piping 3. The roller 2 is rotated around its axis by a mechanical system 4. The tank 5 is supported by a frame shown schematically 7. The pipe 8 is an overflow which serves for recirculating pigmentary suspension into the tank 5. When the pigmentation device shown schematically in FIGS. 3 and 4 is in operation, the composition of the pigments in the form of an aqueous suspension is applied to one surface of the sheet of cardboard 1.

After drying the thus pigmented sheet of cardboard, the latter is subjected to an impregnation treatment with bitumen sufficiently hot to be fluid. This operation calls upon means known in the art since it is already used for the impregnation of sheets of cardboard or other cellulosic substrates not coated with pigments.

The invention is described in more detail in the examples below, which do not limit it in any way and where the proportions and percentages are by weigh, except for indications to the contrary.

EXAMPLE 1

In this example, sheets of cardboard intended for roofing are processed. In a first step, there is applied to one surface of each sheet a pigmented composition by using the application technique illustrated in FIGS. 3 and 4. The various pigmented compositions defined in table B 1 below are used, in which all the figures indicate parts by weight.

TABLE I

| | Pigmentary preparation | | | |
|---|---|---|---|---|
| | Blue Weight | Green Weight | Red Weight | Bronze Weight |
| Pigment | 65 | 75 | 75 | 75 |
| Acrylon A 06 | 1.5 | 1.5 | 1.5 | 1.5 |
| AD 310 | 15 | 10 | 15 | 15 |
| Anti-foaming agent | 0.200 | 0.200 | 0.200 | 0.200 |
| Water | 300 | 300 | 300 | 300 |
| Weight | 381.7 | 386.7 | 321.7 | 391.7 |
| Weight of dry material in kg | 74.95 | 82.2 | 84.95 | 84.95 |
| Per sheet | 75 g | g | 75 g | 75 g |

The pigments used were the following:

Blue: light blue of the BAYER company

Green: green chromium oxide GN of the BAYER company

Red: iron oxide 140 of the BAYER company

Bronze: brown iron oxide of the BAYER company

The product "ACRYLON A 06" is a dispersing agent marketed by the PROTEX Company. The anti-foaming agent is the product marketed under the name "NOPCO NXZ" by the Diamond Shamrock Chemical Company.

The product "AD 310" is a binder constituted by a thermoplastic resin which is a copolymer of vinyl acetate and butyl acrylate marketed by the RHONE-POULENC Company.

The figures of table I for the product AD 310 relate to its commercial form, which is that of a 55% dry extract aqueous emulsion. Converted to weight of dry resin, the figures in the table must be divided substantially by two.

Once the pigment has been applied, these sheets are allowed to dry and then they are subjected to an impregnation-cooking in a bath of hot bitumen at 180° C. After 40 minutes the impregnated sheets are withdrawn from the bitumen bath and are allowed to cool.

When these sheets are subjected to the cross-ruling test described previously, the pigmentary colour does not become detached with the adhesive tape, whereas it partially leaves the support if a traditional material is used prepared by prior impregnation with the bitumen bath and then application of a pigmented composition.

Equivalent results are obtained if, in the formulation given in Table I, the product AD 310 is replaced weight for weight by styrene-acrylic ester copolymers, for example a styrene-butyl acrylate copolymer, or by an acrylic ester homopolymer. Typical products used were styrene, acrylic or vinyl resins or styrene-acrylic or vinyl-acrylic copolymers, selected from among the following products:

Rhodopas SD 104 of the RHONE POULENC Company

Acronal 290 D of the BASF Company

Acronal 230 D of the BASF Company

Vinnapas EP 16 of the WACKER Company
Vinamul 6925 of the SHEBY Company
Vinamul 6133 of the SHEBY Company
Vinamul 3400 of the SHEBY Company
Neocryl A 604 of the POLYVINYL CHEMIE HOLLAND Company
Ercusol AS 250 of the BAYER Company
AC 34 of the ROHM AND HASS Company
AC 388 of the ROHM AND HASS Company
Conchemco 333 003 of the CONCHEMCO Company
U car 365 of the UNION CARBIDE Company
Synresyl CO 58 AE of the SYNRES Company.

EXAMPLE 2

An application technique of pigment to a sheet of cardboard under conditions similar to those in Example 1 was used, but replacing the thermoplastic binder of the composition by a thermosetting binder selected from among the products available on the market under the following names:

ALKYDAL F 30 W (Alkyd resin) of the BAYER Company
Nobelamine 24 836 (urea-formaldehyde resin) of the HOECHST Company
Bakelite resin 55–53 of the Bakelite Company
Nobephene resin of the HOECHST Company
Phenaron L 128 resin of the PROTEX Company
Phenaron L 130 resin of the PROTEX Company
PL 10–175 resin of the PLASTIMER Company
Epoxy resin of the SHELL CHIMIE Company
Thermosetting acrylic resins
Luhydran LR 8434 of the BASF Company
Luhydran L5 8508 of the BASF Company certain of these resins were tested with hardeners. Very satisfactory results were obtained.

EXAMPLE 3

Result similar to those in example 2 were obtained by varying the principal constituents of the pigmentary composition between the following limits:

water: 150 to 450 parts
binder: (in the form of an aqueous emulsion with about 50% dry extract): 150 parts
pigment: 10 to 100 parts.

Optimal results were obtained for an amount of 40 to 50 parts of pigment.

EXAMPLE 4

A coating and colouring composition was prepared comprised of 25% pigment, 5% resin binder in aqueous emulsion, 1°/₀₀ of dispersing agent and 1°/₀₀ of thickening agent, the remainder being water; this composition was applied in a thin layer of only 5 to 7 microns, with a spray gun, to one of the surfaces of the cellulosic felt.

After simple air drying, the coated material was subjected to an impregnation-cooking in a conventional hot bitumen bath, at 180° C.; after 40 minutes, the cellulosic felt was withdrawn from the bitumen bath and it was allowed to cool.

Ageing tests carried out subsequently on this material gave the following results: a naturel ageing over 3 years did not give rise to any notable alteration apart from soiling which could be observed. After acceleration ageing based on 30 cycles of AFNOR T 30 049, carried out in the "Climatron" accelerated ageing equipment, neither alteration, nor reduction in the performance obtained by the stripping tests, were noted.

EXAMPLE 5

A coating and colouring composition related to a dispersion paint was prepared for the outside and comprising, for a filler/binder ratio of 1.4:1, 40% of fillers (composed of chalk, microdolomite or microcalcite to confer optimal particle size filling, and of micromica to provide this filler with moisture resistance and U.V. radiation resistance), 50% of resin binder in aqueous dispersion, 1°/₀₀ of dispersion agent, 1°/₀₀ of thickening agent and 7% of pigment, the remainder being water.

This composition was applied by a roller, to the two surfaces of a cardboard, to form a thin layer of 6 to 10 microns of this composition.

Alter simple air drying, the coated cardboard was dipped into a bitumen bath brought to 180° C., for impregnation for 40 minutes. The cardboard was then withdrawn from the bitumen bath and it was allowed to cool.

Ageing tests carried out subsequently on this material gave the following results: natural ageing over three years did not permit any notable alteration to be detected apart from soiling. After an accelerated ageing based on 30 cycles of AFNOR T 30 049, produced in a "Climatron" ageing apparatus, no alteration, nor reduction in performance in the stripping tests, was observed.

What we claim is:

1. Coloured or dyed material formed from a substrate impregnated with bitumen, said material being characterized by a colour gradient between surface and the inside of the substrate, the colour intensity decreasing continuously and practically regularly from the surface.

2. Material according to claim 1, wherein the density of the pigments is maximum at the surface of the material to a depth of about 5 to 10 microns, after which, this colored layer is followed by a zone where the density of the pigments decreases toward the inside of the material in a practically continuous and regular manner, this zone being able to have a depth of about 20 microns.

3. Material according to claim 1, wherein it includes a substrate based on cellulosic fibers.

4. Material according to claim 1, wherein the coloring agents are pigments capable of resisting the temperatures of impregnation by bitumen and selected from titanium, iron, chromium or other mineral oxides; metallic powders; aluminum, bronze or copper pastes; or mixtures thereof.

5. Method for producing a coloured roofing, siding or sealing material, based on cellulose fibers, cardboard or other fibrous material inpregnated with bitumen, comprising coating at least one of the surfaces of the material to be treated with a colouring composition, drying the coated material, and impregnating the thus coated material in a conventional hot bitumen bath.

6. Method according to claim 5, wherein the coated material is impregnated by immersion in a bitumen bath at about 180° C.

7. Method according to claim 5, wherein said material is a cellulosic felt or a cardboard.

8. Method according to claim 5, wherein said coating or colouring composition is intermediate between (1) a composition including about, by weight, 25% pigment, 5% of resin binder in aqueous emulsion or dispersion, 1°/₀₀ dispersing agent and 1°/₀₀ thickening agent, the remainder being water, and (2) a composition including about, by weight, 7% of pigment, 40% of fillers, 50% of resin binder in emulsion or aqueous dispersion, 1°/₀₀ dispersing agent and 1°/oo thickening agent, the remainder being water.

9. Method according to claim 5, wherein the colouring composition is applied in the form of a pigmentary composition containing a thermoplastic or a thermosetting binder, in amounts as low as 0.1% and going up to 25% of the total weight of the composition, these values being expressed in dry resin extract of the binder.

10. Method according to claim 9, wherein the thermoplastic binder is selected from the group consisting of acrylic ester polymers, vinyl esters polymers, copolymers of such esters, interpolymers of such esters and their copolymers with styrene.

11. Method according to claim 9, wherein the thermosetting binder is selected from the group consisting of phenolic resins, urea-formaldehyde resins, melamine-urea-formaldehyde resins, formaldehyde-phenolic resins and epoxy resins.

12. Method according to claim 9, wherein the pigmentary composition contains water.

13. Method according to claim 12, wherein the amount of water is greater than 60% by weight of the total composition.

14. Method according to claim 9, wherein a pigmentary composition containing, by weight with respect to the total weight of the composition, 150 to 450 parts of water, 150 parts of binder with 50% dry resin extract, and 10 to 100 parts of pigment is used.

* * * * *